US005363570A

United States Patent [19]

Allen et al.

[11] Patent Number: 5,363,570

[45] Date of Patent: Nov. 15, 1994

[54] SHOE SOLE WITH A CUSHIONING FLUID FILLED BLADDER AND A CLIP HOLDING THE BLADDER AND PROVIDING ENHANCED LATERAL AND MEDIAL STABILITY

[75] Inventors: Bernie Allen, Wayland; Aaron Azevedo, Boston; Eckhard Knoepke, Duxbury; Neal F. X. Kimball, Framingham; Philip L. Blake, Marblehead; John A. Hayes, Milton, all of Mass.; John A. Healy, Madbury, N.H.; Christopher J. Edington, Shrewsbury, Mass.

[73] Assignee: Converse Inc., North Reading, Mass.

[21] Appl. No.: 254,171

[22] Filed: Jun. 6, 1994

Related U.S. Application Data

[63] Continuation of Ser. No. 13,573, Feb. 4, 1993.

[51] Int. Cl.[5] ..... A43B 13/18; A43B 21/26

[52] U.S. Cl. ..... 36/28; 36/29; 36/35 B; 36/114

[58] Field of Search ..... 36/28, 29, 35 R, 35 B, 36/31, 71, 114

[56] References Cited

U.S. PATENT DOCUMENTS

| | | | |
|---|---|---|---|
| 2,260,224 | 10/1941 | Hubbard, Jr. . | |
| 2,288,388 | 6/1942 | Bolten et al. . | |
| 2,402,227 | 6/1946 | Ihle . | |
| 2,532,742 | 12/1950 | Stoiner | 36/35 B |
| 3,748,758 | 7/1973 | Wilchusky . | |
| 4,014,115 | 3/1977 | Riechert . | |
| 4,219,945 | 9/1980 | Rudy . | |
| 4,437,673 | 9/1982 | Svetlik | 36/32 R |
| 4,471,538 | 9/1984 | Pomeranz et al. . | |
| 4,610,099 | 9/1986 | Signori | 36/29 |
| 4,817,304 | 4/1989 | Parker et al. | 36/114 |
| 4,843,741 | 7/1989 | Yung-Mao . | |
| 4,845,863 | 7/1989 | Yung-Mao . | |
| 4,887,367 | 12/1989 | Mackness et al. | 36/28 |
| 5,005,300 | 4/1991 | Diaz et al. | 36/114 |
| 5,079,856 | 1/1992 | Truelsen | 36/28 |
| 5,131,174 | 7/1992 | Drew et al. | 36/35 B |
| 5,175,946 | 1/1993 | Tsai | 36/29 |
| 5,191,727 | 3/1993 | Barry et al. | 36/29 |
| 5,195,257 | 3/1993 | Holcomb et al. | 36/28 |
| 5,220,737 | 6/1993 | Edington | 36/29 |

*Primary Examiner*—Paul T. Sewell
*Assistant Examiner*—Marie Denise Patterson
*Attorney, Agent, or Firm*—Rogers, Howell & Haferkamp

[57] ABSTRACT

The present invention pertains to a shoe sole containing a cushioning fluid filled bladder and a clip holding the bladder in a set position in the shoe sole and providing enhanced lateral and medial stability to the sole.

25 Claims, 6 Drawing Sheets

38
108
98
42
50
44
106
48
40
96
46

94
3
54
112
74
90
110
100
102
92
104
64
68
56
52

SHOE SOLE WITH A CUSHIONING FLUID FILLED BLADDER AND A CLIP HOLDING THE BLADDER AND PROVIDING ENHANCED LATERAL AND MEDIAL STABILITY

This is continuation of copending application Ser. No. 08/013,573; filed on Feb. 4, 1993.

BACKGROUND OF THE INVENTION (1) Field of the Invention

The present invention pertains to a shoe sole containing a cushioning fluid filled bladder and a clip holding the bladder in a set position in the shoe sole and providing enhanced lateral and medial stability to the sole.

(2) Description of the Related Art

Many shoe soles, in particular athletic shoes, require a certain amount of cushioning to absorb the shock of footstep impact in walking, running and other activities, and thereby provide some protection to the shoe wearer's foot. This is most evident in the heels of many athletic shoes, the heel portion of the sole typically being the first portion of the sole to impact with the ground during running. However, merely adding additional cushioning to the heel of a shoe sole has been found to be insufficient to protect the foot in several respects.

In running, the initial impact of a shoe sole on each footstep is typically along the outer, lateral edge of the runner's heel. As the cushioning of the shoe sole heel gives under the force of the footstep impact, the force of impact is concentrated on the lateral edge of the runner's heel and is not distributed over the entire heel surface. The initial impact on the outer edge of the runner's heel also tends to cause the rotation of the foot relative to the leg, or a lowering of the medial margin of the foot commonly known as pronation. Excessive pronation is believed to be related to many different injuries of the foot. During walking, running or other activities it is also possible that initial impact on the lateral border of the shoe sole will be followed by supination of the foot, or the raising of the medial margin of the foot. As the shoe cushioning gives under impact, the force of impact is concentrated on the lateral edge of the heel and is not distributed over the heel surface. Excessive supination of the foot is commonly believed to be related to different injuries of the foot and ankle.

What is needed to overcome the above-described disadvantages of prior art athletic shoes is an apparatus that cushions the sole of a shoe, causing the forces due to each footstep impact to be distributed over a greater area of the foot than just the lateral or medial edges of the foot. What is also needed to overcome the above-described disadvantages is an apparatus in a shoe sole that stabilizes the foot in the shoe and reduces the tendency of the runner's ankle to bend in pronation and supination with each footstep impact.

SUMMARY OF THE INVENTION

The present invention overcomes the above-described disadvantages associated with prior art shoe soles by providing a shoe sole comprising a fluid filled bladder contained in the heel area of the sole providing cushioning to the shoe wearer's heel, and by providing a fluid bladder clip that is also contained in the heel area of the sole surrounding the bladder and positively locating the bladder in the sole while providing lateral and medial stabilization of the shoe sole on opposite lateral sides of the bladder. In variant embodiments of the invention the fluid filled bladder has the general configuration of a toroid, an anatomically determined configuration, or any other variant configuration, and the bladder clip has a complementary configuration that engages around and supports the bladder in the midsole of the shoe sole.

The fluid filled bladder is comprised of two or more fluid filled chambers. Preferably one of the two chambers is positioned at a center of the bladder, and a second chamber completely surrounds the one chamber. Each of the chambers is constructed of a flexible plastic material, and the interiors of the chambers are filled with a composite fluid that may include two fluids having different viscosities or fluid mixed with solids such as a sponge-like foam or small hollow spheres or particles suspended in the fluid. The two or more chambers are connected in fluid communication by a plurality of fluid conduits that extend between the chambers. The conduits are configured to enable passage of the fluid between the chambers while restricting the rate of flow between chambers.

The shoe sole of the present invention is similar to conventional running shoe soles except that it is provided with the fluid filled bladder in the heel area of the midsole. To provide lateral and medial stability to the heel area of the midsole as well as to protect the bladder from being punctured and to positively locate the bladder in a desired position in the shoe sole, a fluid bladder clip is provided in the midsole. The clip engages around the fluid bladder and holds the bladder in position in the shoe sole and also provides a protective layer of material beneath the bladder to protect the bladder from being punctured by objects exterior to the shoe sole.

In one embodiment of the invention the fluid bladder clip is molded into the material of the midsole. In this embodiment, the clip is formed by a hollow cavity that depends downward into the material of the midsole from the top surface of the midsole. A sidewall is molded in the midsole extending around the cavity and defining the hollow interior of the clip. At the bottom of the clip cavity a resilient base skin is formed. The base is formed unitarily with the cavity sidewall, the sidewall extending upward from a peripheral edge of the base. The base has a bottom surface opposite the top surface of the base that forms the bottom wall of the clip cavity. The base bottom surface is exposed to the exterior of the shoe sole and has a general concave configuration. The concave configuration spaces the base bottom surface above the bottom surface of the midsole and also enables the resilient base to function in a trampoline-like manner in providing enhanced cushioning to the heel of the shoe wearer. The clip constitutes the entire midsole in the area of the shoe heel and is formed from a transparent material enabling the bladder contained in the midsole clip to be seen from outside the shoe. The clip also provides protection of the bladder from heat or excessive pressures during use of the shoe.

An outsole constructed of a material that is less flexible and less subject to wear than the material of the midsole is secured to the bottom surface of the midsole. The outsole is provided with an opening in the area of the shoe heel. The opening is positioned directly beneath the concavity of the midsole base skin and the fluid bladder supported in the clip cavity, thereby elevating the bottom surface of the resilient base above the tread surface of the shoe sole.

In a further embodiment of the invention the fluid bladder clip is provided as a separate component part of the shoe sole that is encapsulated in the midsole. This embodiment of the clip is also provided with a resilient base skin having a top surface configured to positively locate and support the fluid filled bladder on the surface of the base within the clip. The clip is provided with a side wall that is formed as a unitary extension of the periphery of the base skin top surface. The side wall surrounds and engages the periphery of the fluid bladder supported on the base top surface. The base bottom surface is formed in a concave configuration with the concavity of the surface spacing the base bottom surface above the bottom surface of the midsole with the clip encapsulated in the midsole. The clip is constructed entirely of a transparent material and the midsole encapsulating the clip is formed with several apertures that extend into the midsole to the clip and enable the bladder contained in the clip to be seen from outside the shoe sole.

An outsole constructed of a material being less flexible and less subject to wear than the material of the midsole is secured to the underside of the midsole. The outsole has an opening formed therein beneath the bladder clip encapsulated in the midsole and exposing the concave bottom surface of the clip base skin to the exterior of the shoe. The concavity of the clip bottom surface spaces the bottom surface above the tread surface of the outsole and forms a void beneath the clip base and the fluid bladder supported by the clip.

In both embodiments of the invention, the fluid filled bladder contained in the midsole by the bladder clip serves to cushion the shock exerted on the heel at each footstep impact. The ability of the fluid to flow through the conduits between the two or more chambers of the bladder serves to distribute the shock of footstep impact over a greater area of the runner's heel, and thereby reduce the shock of impact and the likelihood of excessive pronation or supination. The specific configuration of the fluid bladder is determined to provide increased stability and support and to cradle the heel in the shoe sole and also provide a custom fit of the foot heel on the shoe sole.

By positioning the fluid filled bladder inside the two embodiments of the bladder clip described above, the increased rigidity of the clip sidewall compared to the cushioning of the bladder contained in the clip increases the resistance to compression of the midsole around the periphery of the bladder thereby increasing the lateral and medial stability of the midsole. Because the clip sidewall is positioned around the periphery of the fluid bladder it does not significantly affect or detract from the cushioning of the bladder provided to the shoe wearer's heel.

In the first embodiment of the invention wherein the bladder clip is formed in the midsole of the shoe sole, the midsole is constructed of a transparent material enabling the viewing of the fluid bladder inside the midsole. In this embodiment, the outsole is constructed of an opaque material and is secured to an underside of the midsole where it does not obstruct the viewing of the fluid bladder contained in the midsole. In the second embodiment of the invention employing the bladder clip encapsulated in the midsole, the clip is constructed of a transparent material and the midsole and outsole materials are opaque. The midsole in this embodiment is formed around the bladder clip with one or more apertures extending from the exterior of the midsole through to the sidewall of the clip thereby enabling viewing the fluid bladder contained in the clip from outside the shoe sole. In this embodiment, the opening provided in the outsole also enables viewing of the bladder contained in the clip from outside the shoe sole through the opening in the outsole.

BRIEF DESCRIPTION OF THE DRAWINGS

Further objects and features of the present invention are revealed in the following detailed description of the preferred embodiments of the invention and in the drawing figures wherein.

DESCRIPTION OF THE PREFERRED EMBODIMENTS

The shoe sole of the present invention is generally comprised of a midsole and an outsole, with the midsole containing a fluid filled bladder and being provided with a clip structure for containing and supporting the fluid bladder. Two embodiments of the shoe sole are disclosed herein. In a first embodiment of the shoe sole, the bladder containing clip is formed as a unitary part of the shoe sole construction. In the second embodiment of the shoe sole, the bladder containing clip is a separate component part of the shoe sole encapsulated in the shoe sole. In both embodiments of the shoe sole a fluid filled bladder is contained by the clip in the sole. Although preferred embodiments of a fluid filled bladder are disclosed and described in association with the two embodiments of the fluid clip, it should be understood that other types of fluid filled bladders may be employed with the bladder clip and shoe soles of the invention without departing from the intended scope of the invention defined in the claims.

Figure 13:
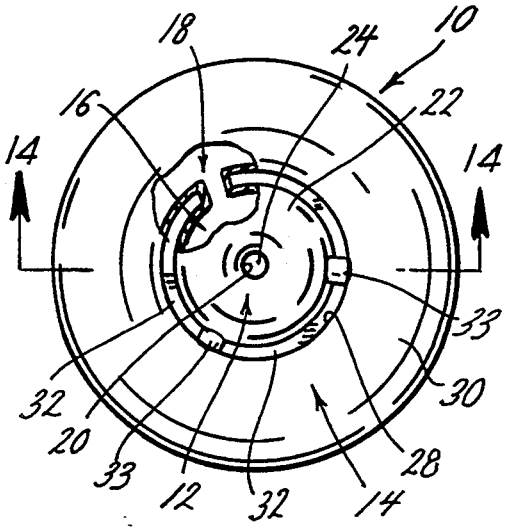
FIG. 13 is an elevation view of the fluid filled bladder of the invention.
Figure 14:
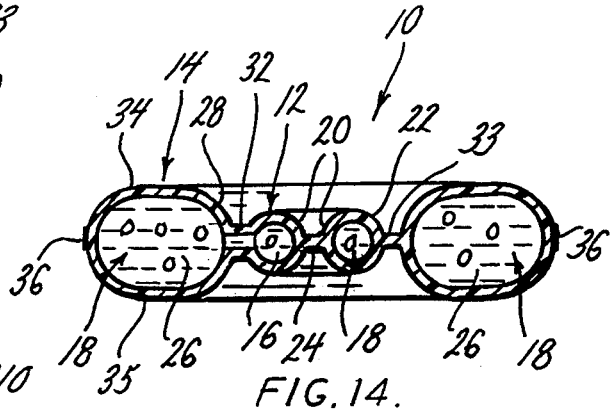
FIG. 14 is a side elevation view, in section, of the fluid bladder taken along the line 14—14 of FIG. 13.
Figure 15:
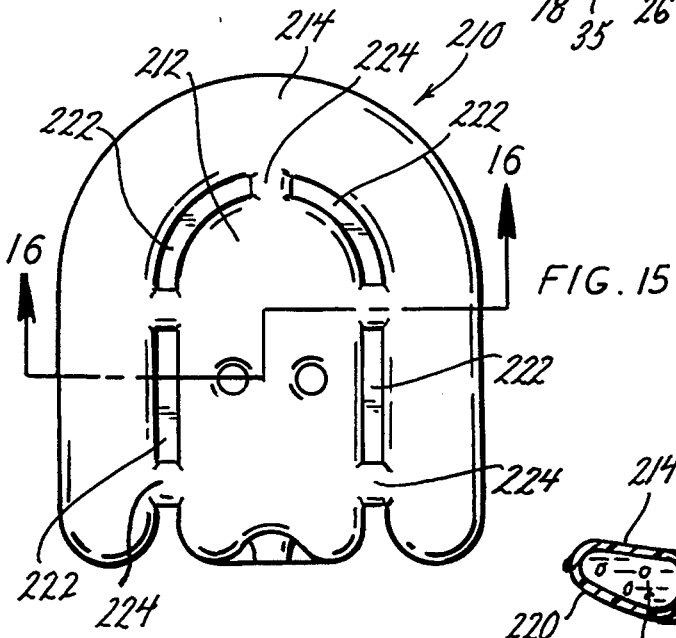
FIG. 15 is an elevation view of a second embodiment of the fluid filled bladder.

In the first described embodiments of the invention, the fluid filled bladder 10 has the general configuration of concentric toroids shown in FIGS. 13 and 14. The bladder is constructed from a transparent, flexible, fluid barrier material, preferably a plastic type film that is capable of being bonded. Polyurethane is preferred for constructing the bladder. However, other types of flexible, fluid barrier materials and other methods may be employed in constructing the bladder of the invention without departing from the intended scope of the claims. For example, the bladders may be vacuum formed or may be formed by extrusion blow molding of a flexible, fluid tight material. In blow molding, the bladders are formed in two mirror-image halves that are sealed together so that the seal around their peripheral edges projects only 0.5 mm from the circumference of the bladders, allowing better visibility of the bladders' contents from the side and through the seal.

As seen in FIGS. 13 and 14, the fluid bladder 10 is generally comprised of an inner, smaller toroid 12 and an outer, larger toroid 14. The smaller toroid 12 contains a hollow, annular interior chamber 16 filled with a fluid 18. The exterior configuration of the toroid 12 is defined by an inner perimeter wall 20 of the toroid and an outer perimeter wall 22. The center hole of the smaller toroid 12 is covered over by a web 24 of the flexible material employed in constructing the toroid apparatus.

The larger toroid 14 completely surrounds and is concentric to the smaller toroid 12. The larger toroid 14 also contains a hollow, annular interior chamber 26. The larger toroid chamber 26 is also filled with the same fluid 18 filling the interior chamber 16 of the smaller toroid 12. The exterior configuration of the toroid 14 is defined by an inner perimeter wall 28 of the toroid and an outer perimeter wall 30 of the toroid.

Web sections 32 are formed between the outer perimeter wall 22 of the smaller toroid 12 and the inner toroid perimeter wall 28 of the larger toroid 14. The web sections 32 secure the two toroids 12, 14 together in their relative positions shown in the drawing figures. The web sections 32 are formed from the same flexible material employed in constructing the toroid apparatus.

Three fluid conducting conduits 33 extend between the outer perimeter wall 22 of the smaller toroid 12 and the inner perimeter wall 28 of the larger toroid 14. The fluid conduits 33 communicate with the interior chambers 16, 26 of the two toroids 12, 14 and enable the fluid 18 to flow between the toroid interior chambers through the conduits. As seen in drawing FIG. 13, the fluid conduits 33 are arranged in a spoke-like manner between the two toroids, separating the arcuate web sections 32. The center web section 24, the smaller toroid 12, the fluid conduits 33 and the arcuate web sections 32, and the larger toroid 14 are all substantially co-planar as is shown in FIG. 14.

The toroid apparatus 10 is formed from a pair of overlapping sheets of transparent, flexible, fluid tight material. As shown in FIG. 14, the upper sheet 34 and the lower sheet 35 are both formed in two mirror-image halves each having the concentric toroid configuration. This may be done by a conventional, extrusion blow molding process. The upper sheet 34 is layed over the lower sheet 35 and is bonded to the lower sheet. The sheets are bonded together along a perimeter seam 36 extending around the outside of the larger toroid 14, at the arcuate web sections 32 between the smaller 12 and larger toroid 14, and at the center web 24 of the smaller toroid. As the upper and lower sheets are secured together along the arcuate sections 32, the intervals between the adjacent sections are not bonded, thereby forming the fluid conduits 33 that communicate the smaller toroid interior chamber 16 with the larger toroid interior chamber 26. In this particular construction, the perimeter seam 36 is positioned substantially at the middle of the toroid bladder with both the top and bottom surfaces of the bladder being mirror images of each other. The seam 36 projects only about 0.5 mm from the bladder's circumference, thereby allowing better visibility of the bladder's fluid contents from the side and through the seam.

With the toroid bladder constructed in the manner described, the inner chambers of the two toroids are filled with the composite fluid 18. The composite fluid could include two fluids having different viscosities or the fluid could include solids including, but not limited to, a sponge-like foam or small hollow spheres or particles suspended in the fluid. The above described method of constructing the toroid apparatus of the invention 10 is illustrative only and is not intended to be limiting. Furthermore, as stated above, the fluid bladder clips of the shoe sole of the invention yet to be described may be employed with fluid bladders having different configurations other than that described above.

Figures 1, 2:
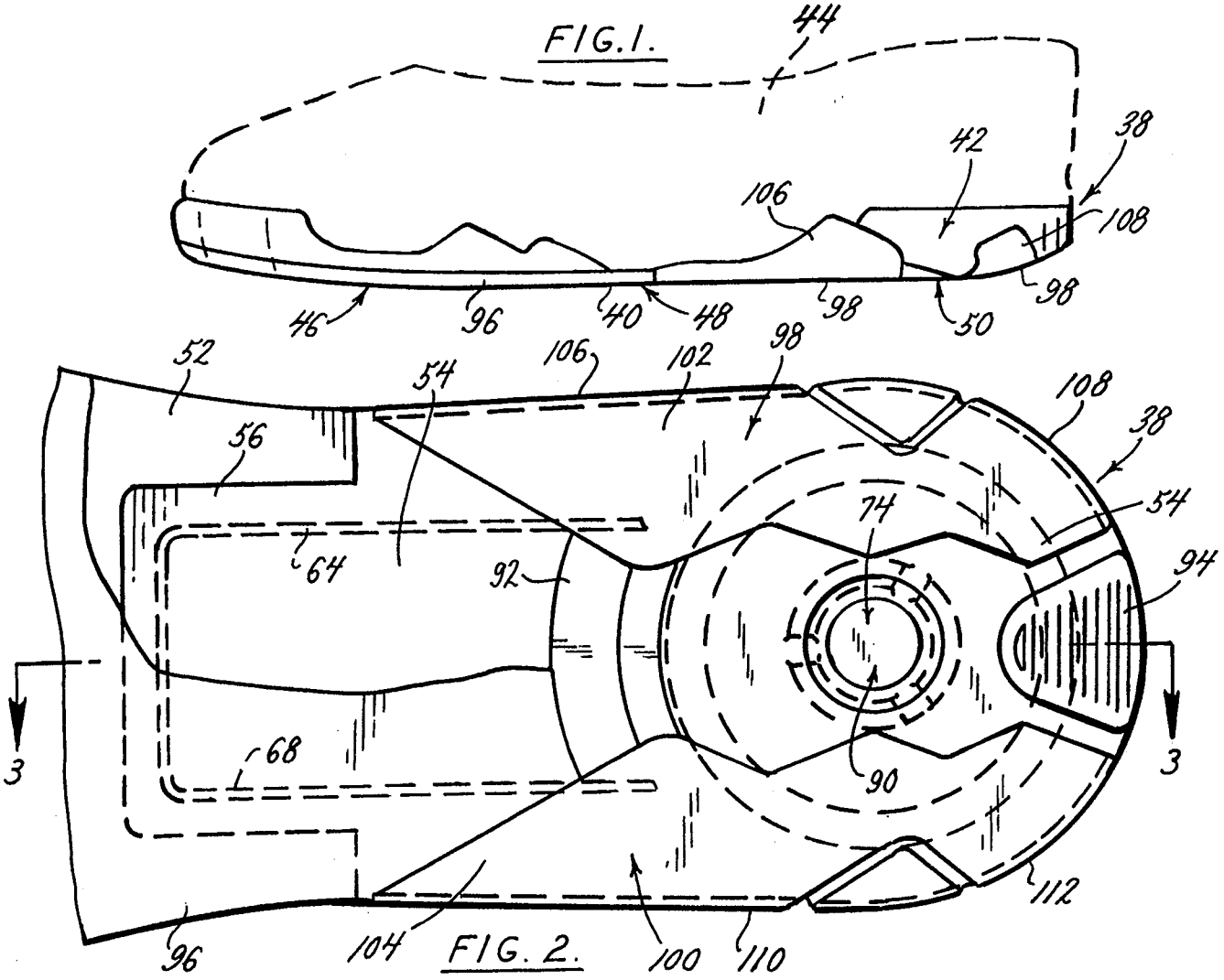
FIG. 1 is a partial side elevation view of a first embodiment of the shoe sole of the present invention.
FIG. 2 is a partial bottom plan view of the shoe sole of FIG. 1.

In the preferred embodiments of the invention, the fluid filled bladder 10 is contained in the midsole of a shoe sole. In the first embodiment of the shoe sole of the invention, the shoe sole 38 is comprised of the component parts shown in FIGS. 1–8. The shoe sole is generally comprised of an outsole 40 and a midsole 42 connected to a shoe upper 44. As seen in FIG. 1, the outsole and midsole extend longitudinally across the bottom of the shoe and include forefoot sections 46, arch sections 48, and heel sections 50.

Figure 3:
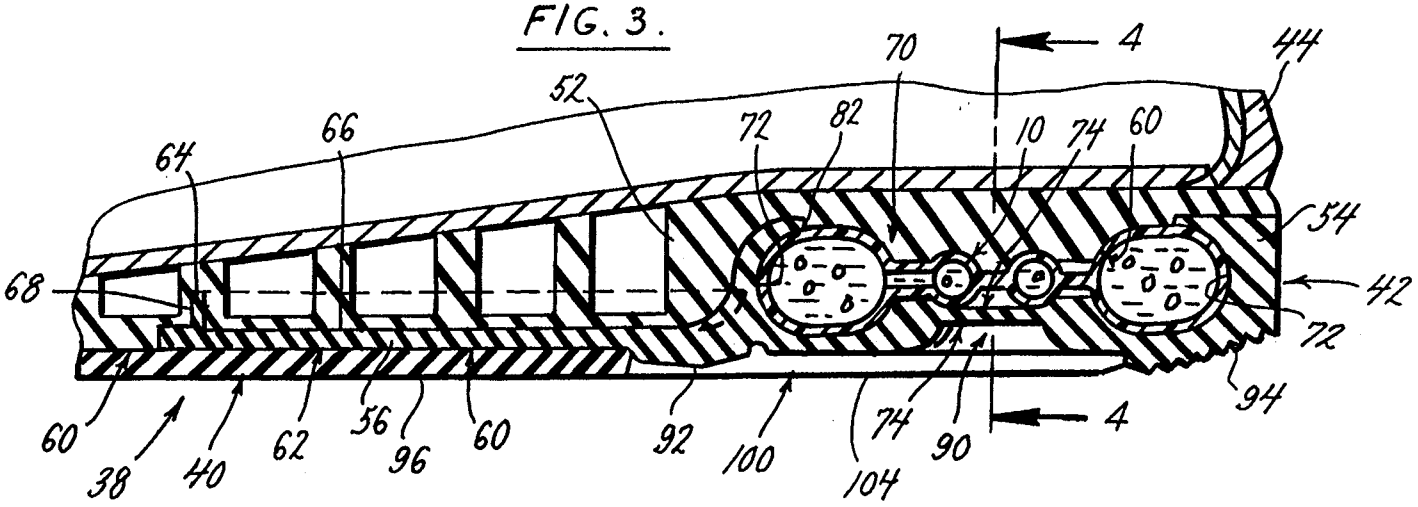
FIG. 3 is a partial side elevation view in section taken along the line 3—3 of FIG. 2.

The shoe midsole 42 is constructed of two component parts including an upper portion 52 that extends along the longitudinal length of the shoe over the forefoot, arch and heel sections, and a lower midsole portion 54 that extends longitudinally along only the heel portion of the shoe sole. The upper midsole 52 is constructed of a flexible opaque material that provides cushioning to the underside of the shoe wearer's foot while supporting the shoe wearer's foot. The lower midsole 54 is constructed of a flexible material that is transparent. The material of the lower midsole 54 is also flexible but somewhat more rigid than the flexible material of the upper midsole 52 to enhance its ability to resist wear through use of the shoe sole. The forward portion 56 of the lower midsole is formed as a relatively thin flexible flap that is fit into a recessed plane 58 formed in the underside 60 of the upper midsole 52. The recessed plane 58 of the upper midsole enables the underside of the upper midsole 60 and the underside of the lower midsole 62 to form a continuous lower surface of the midsole 42 with the upper and lower midsoles assembled together as shown in FIG. 3. A generally rectangular three-sided ridge 64 is formed in the top surface 66 of the lower midsole. A complementary shaped three-segment slot 68 is formed in the underside of the upper midsole 60 and the ridge 64 fits into the slot 68 with the upper and lower midsoles assembled together to securely hold the lower midsole in its desired position relative to the upper midsole. The upper and lower midsoles may be secured together by adhesives or by any other equivalent method. As the opposed lengths of the ridge 64 extend longitudinally rearward toward the heel area of the midsole they are joined integrally with a thickened portion of the midsole heel. The ridge serves to connect the opposite lateral sides of the midsole heel section with an intermediate portion of the shoe sole just forward of the heel and thereby provides increased torsional rigidity to this area of the sole and increases stability. The ridge 64 projecting upward from the midsole top surface 60 acts as a reinforcing web over this surface that increases the midsole's torsional rigidity. The material that makes up the midsole forward portion 56 may be constructed of a more rigid material than the remainder of the midsole to further enhance its torsional rigidity.

Figure 4:
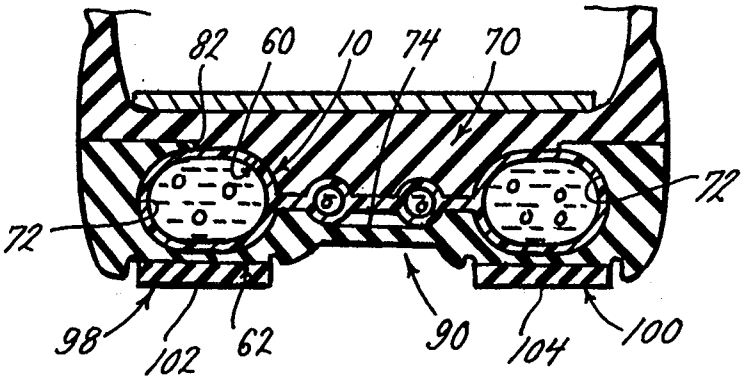
FIG. 4 is a partial rear elevation view in section taken along the line 4—4 of FIG. 3.
Figure 5:
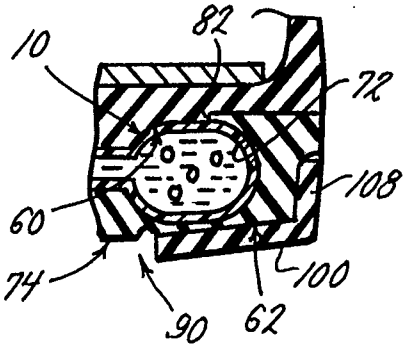
FIG. 5 is a partial elevation view in section of the shoe sole of FIG. 1.
Figure 6:
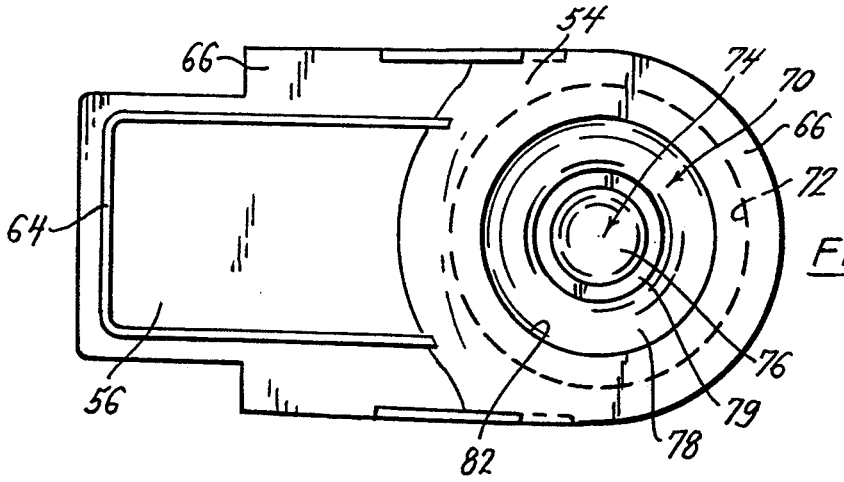
FIG. 6 is a top plan view of the first embodiment of the bladder clip of the invention.

As the lower midsole 54 extends rearward from the forward portion 56, its vertical thickness increases in the area of the lower midsole positioned just below the heel of the shoe wearer's foot. In this heel area of the lower midsole a cavity 70 is formed in the top surface 66. The cavity 70 has an interior volume shaped complementary to the shape of the toroid fluid filled bladder 10 described earlier with a sidewall 72 that surrounds and engages around the periphery of the bladder and a resilient base skin 74 extending across the bottom of the cavity 70 and having a top surface shaped complementary to the exterior surface of the bladder. For bladders of different shapes the cavity will also have a different shape complementary to the particular shape of the bladder. As best seen in FIG. 6, the cavity 70 is formed with a central recess 76 for the smaller toroid of the bladder and a peripheral recess 78 for the larger toroid of the bladder. A raised circle 79 separates the two recesses. As seen in FIGS. 3–5, the cavity sidewall 72 extends upward as a unitary extension of the resilient base skin 74 from the bottom of the cavity up over a portion of the top surface of the bladder 10 to the opening 82 of the cavity in the top surface 66 of the lower midsole. In this manner, the resilient base 74 supports the fluid filled bladder 10 on the base top surface and the cavity sidewall 72 securely holds the bladder inside the cavity. The flexible material that forms the cavity sidewall 72 is also somewhat more rigid than the bladder and provides increased resistance to compression of the midsole at the opposite lateral sides of the bladder as viewed in FIG. 4. This serves to enhance the lateral stability of the shoe midsole and also serves to avoid excessive ankle pronation or supination by the wearer of the shoe.

Figure 7:
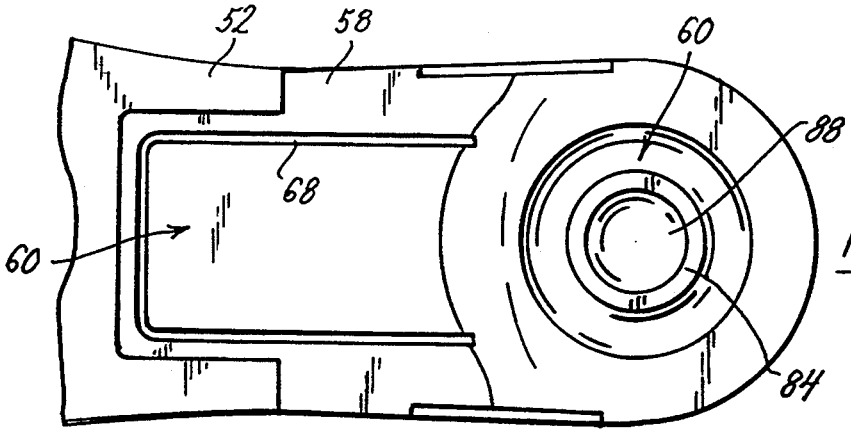
FIG. 7 is a bottom plan view of the shoe midsole configured to receive the bladder clip of FIG. 6.
Figure 8:
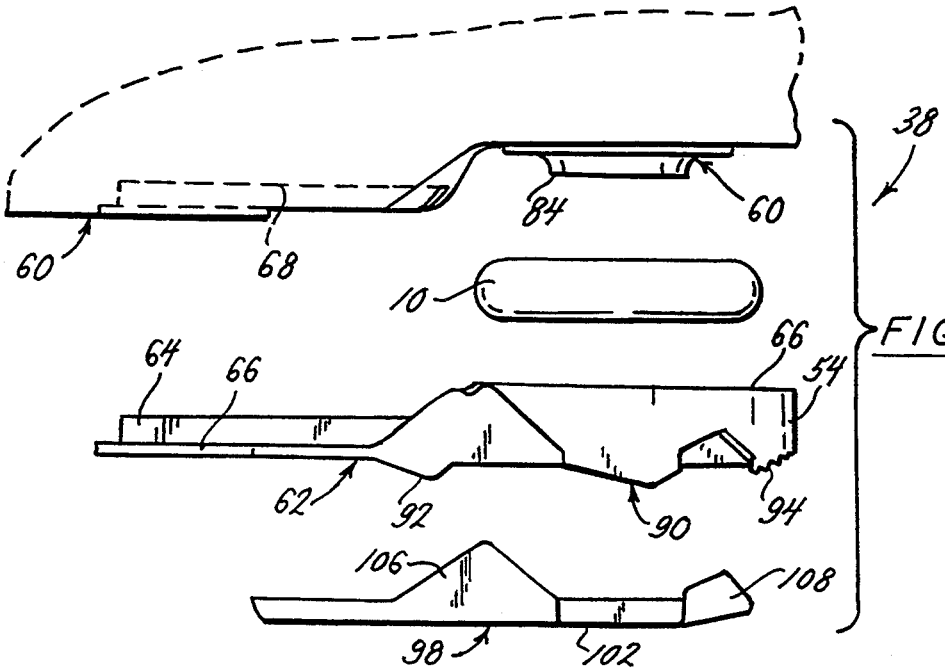
FIG. 8 is a side elevation view showing the component parts of the shoe sole of FIG. 1.

The bottom surface or underside 60 of the upper midsole 52 just above the lower midsole cavity 70 is also given a shape complementary to the shape of the top surface of the bladder 10 and the cavity opening 82 formed in the lower midsole. As shown in FIGS. 7 and 8, the underside 60 of the upper midsole is formed with a projecting ring 84. A center recess 88 is formed in the center of the ring 84 and the underside of the upper midsole slopes away from the ring 84 outside the ring to mate complementary to the outside toroid of the fluid bladder. The complementary close fitting relationship between the lower midsole cavity 70, the fluid bladder 10, and the bottom surface 60 of the upper midsole can be seen in FIGS. 3–5 which shows the assembled relationship of the upper and lower midsoles with the fluid bladder contained therebetween.

A generally concave recess 90 is formed in the bottom surface 62 of the lower midsole just below the resilient base skin 74 supporting the fluid bladder in the midsole cavity 70. The recess 90 spaces the resilient base 74 above the exterior tread surface of the shoe sole and enables the base to function in a trampoline-like manner in supporting the fluid bladder and cushioning the heel of the shoe wearer's foot. By removing the material of the lower midsole from the area of the recess 90, the resiliency of the base skin 74 is increased thereby enhancing the ability of the base to deflect downward into the void formed below the recess 90 in response to forces exerted on the top surface of the midsole upper portion 52 due to footstep heel impact.

The spacing of the resilient base 74 above the exterior tread surface of the shoe sole is further enhanced by an arcurate ridge 92 formed in the bottom surface of the lower midsole 62 and a rear tab 94 also formed in the bottom surface of the lower midsole. As is best seen in FIG. 3, the ridge 92 and tab 94 further space the resilient base 74 above the exterior tread surface of the shoe sole.

The positioning of the outsole 40 on the bottom surface of the midsole 42 further elevates the resilient base skin 74 above the tread surface of the shoe sole and also provides protection to the midsole from excessive wear due to use of the shoe sole. The outsole 40 is generally comprised of three component parts including a forward portion 96 formed beneath the forefoot and arch areas of the shoe sole and a pair of rear lateral segments 98, 100 secured at the opposite lateral sides of the lower midsole bottom surface 62. The tread surface of the shoe is formed on the underside of the three outsole portions 96, 98, 100, and as stated earlier, because the outsole portions are formed of a resilient material that is more resistant to wear than the material of the midsole portions, the positioning of the outsole portions beneath the exposed portions of the midsole protect the midsole from excessive wear through use of the shoe. As seen in FIGS. 2 and 3, the first portion of the shoe outsole 96 is configured to be secured to and cover the undersides of the two midsole portions over the forefoot and arch areas of the shoe and extending back toward the heel area of the shoe up to the arcuate ridge 92 formed in the bottom surface 62 of the lower midsole. As seen in FIG. 3, this forward portion 96 of the outsole slightly elevates the lower midsole 54 above the tread surface formed in the underside of the outsole portion 96 and thereby protects the lower midsole from excessive wear through use of the shoe. The forward outsole portion 96 is secured to the undersides of the two midsole portions by adhesive or by any other equivalent method.

The outsole lateral segments 98, 100 are mirror images of each other and cover over only lateral portions of the lower midsole bottom surface 62. Major portions 102, 104 of the respective outsole lateral segments 98, 100 cover over the bottom surface of the lower midsole 62 in the positions shown in FIG. 2. As seen in FIGS. 3–5, these major portions 102, 104 of the respective outsole lateral segments 96, 98 also serve to elevate the resilient base skin 74 formed in the lower midsole 54 above the shoe sole tread surface formed in the underside of the lateral segments 98, 100 and thereby protect the base skin and the bottom surface of the midsole from excessive wear. The major portions of the lateral segments also enhance the ability of the base skin to deflect downward into the void 90 formed between the base and the tread surface of the sole in response to forces exerted on the top of the midsole and fluid bladder due to footstep impact of the shoe wearer's heel. The spacing of the two outsole major portions 102, 104 at the opposite lateral sides of the midsole bottom surface 62 also enables the viewing of the fluid bladder 10 contained in the clip cavity through the transparent material of the lower midsole 62 from the bottom surface. The attachment of the outsole major portions 102, 104 to the lower midsole bottom surface 62 is enhanced by side portions 106, 108, 110, 112 of each of the respective major portions 102, 104 that extend a slight distance up the opposite lateral sides of the lower midsole 60 and are secured thereto by adhesives or other equivalent methods. The pair of outsole side portions 106, 108 and 110, 112 on the opposite lateral sides of the lower midsole 62 are spaced longitudinally from each other forming a midsole window between the spaced side portions that enables the viewing of the fluid bladder contained in the midsole clip cavity from the opposite lateral sides of the shoe sole through the transparent material of the lower midsole.

By constructing the shoe sole in the manner described above, the shoe sole of the invention holds the fluid bladder 10 in an optimum position of the sole directly below the heel of the shoe wearer's foot and in the described embodiment of the shoe sole and fluid bladder, the complementary configuration of the clip cavity 70 and the mating underside of the upper midsole portion provide a toroid lock that positively secures the toroid fluid bladder in its desired position in the heel area of the shoe sole. The sidewall of the lower midsole that surrounds the fluid filled toroid in the clip cavity also provides lateral stability to the outer lateral edges of the shoe sole by being constructed of material that is more resistent to compression due to footstep impact than is the fluid contained in the bladder. The resilient base skin 74 underlying the fluid bladder protects the bladder from puncture by objects exterior to the shoe sole and the transparent material of the lower midsole enables the viewing of the fluid bladder from below the shoe sole and from the opposite lateral sides of the shoe sole. The concave configuration of the underside of the resilient base skin and the elevating of the base provided by the outsole segments enable the resilient base to function in a trampoline-like manner that further enhances the ability of the fluid bladder supported on the base to provide cushioning to the heel area of the shoe wearer's foot.

A second embodiment of the shoe sole is shown in FIGS. 9–12 of the drawings. This embodiment also employs the fluid bladder 10 having the concentric toroids configuration described above. However, this embodiment of the shoe sole may also employ a fluid filled bladder having a configuration other than that of the toroid fluid bladder. The second embodiment of the shoe sole of the invention is similar to the first embodiment in that it also is comprised of a midsole 116 connected with the shoe upper 118 and an outsole 120 connected to an underside of the midsole. The midsole 116 differs from the first embodiment in that it is not comprised of upper and lower sections but includes a resilient fluid bladder clip 122 that is encapsulated in the material of the midsole 116.

Figure 12:
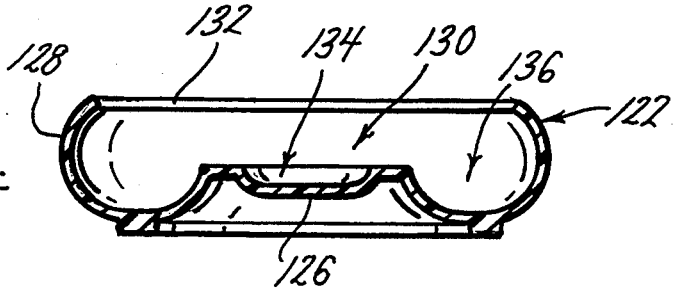
FIG. 12 is an elevation view, in section, of the second embodiment of the fluid bladder clip.

The bladder clip 122 can best be seen in FIG. 12 where it is shown removed from the interior of the midsole. The clip is constructed of a resilient, flexible material that is transparent. The clip is constructed with a resilient base skin 126 extending across the bottom of the clip and a resilient sidewall 128 formed as a unitary extension of the base that extends up and around the interior volume 130 of the clip. The top most edge of the sidewall forms an opening 132 into the clip interior forming a cavity having an interior configuration specifically designed to compliment the exterior configuration of the bladder. As in the first embodiment of the invention, the top surface of the base 126 is configured with a recess 134 at its center to receive the center, smaller toroid of the bladder and a larger annular recess 136 around its periphery to receive the larger toroid of the bladder. The clip sidewall 128 extends as a unitary extension of the periphery of the base skin 126 around the exterior of the fluid bladder 10 to securely hold and positively position the bladder in the interior cavity of the clip. In this regard, the clip 122 is substantially identical to the clip of the first embodiment of the invention.

Figure 9:
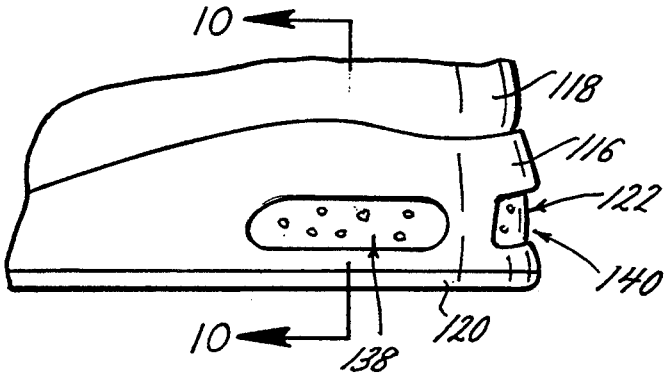
FIG. 9 is a partial side elevation view of the second embodiment of the shoe sole of the invention.
Figure 10:
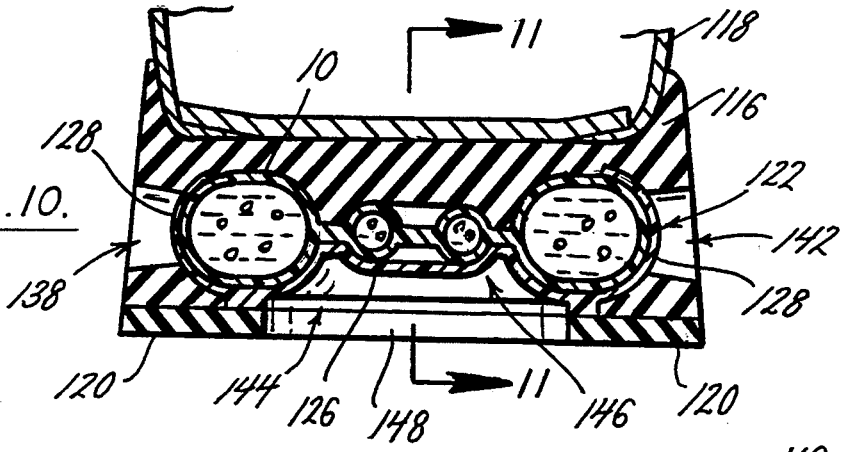
FIG. 10 is a partial rear elevation view, in section, taken along the line 10—10 of FIG. 9.
Figure 11:
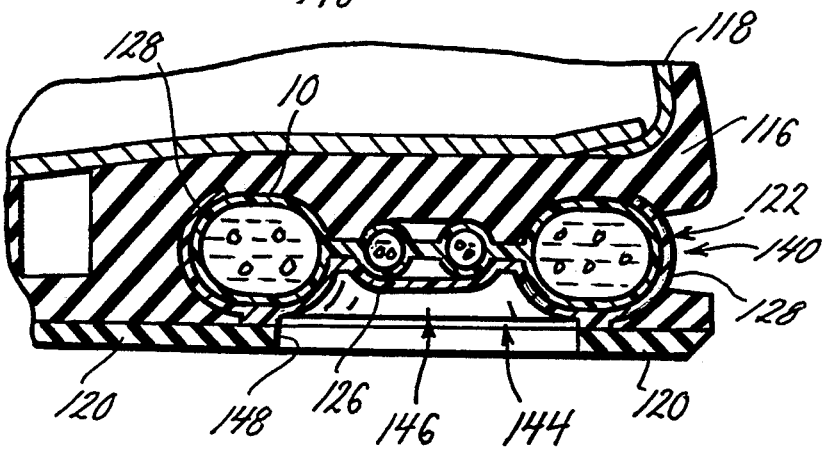
FIG. 11 is a partial side elevation view, in section, taken along the line 11—11 of FIG. 10.

As seen in FIGS. 9–11, the bladder clip 122 is encapsulated in the material of the shoe midsole 116. The shoe midsole 116 is constructed of a resilient, opaque material that is slightly more flexible than the transparent, resilient material of the clip. The more rigid material of the clip 122 enables the clip sidewall 128 to provide increased resistance to compression adjacent the opposite lateral sides of the midsole 116, and thereby enhances the lateral stability of the shoe sole. As shown in the drawing figures, the material of the midsole 116 is molded around the clip 122 containing the fluid bladder. The clip positively locates the bladder in a desired position of the midsole directly beneath the heel of the shoe wearer's foot. Three apertures 138, 140, 142 are molded in the material of the midsole and extend from an exterior surface of the opposite lateral sides and the rear of the midsole through to the sidewall 128 of the clip. These three apertures enable the viewing of the fluid bladder contained in the clip through the apertures and the transparent material of the clip sidewall. A larger aperture or recess 144 is also molded in the midsole 116 directly below the resilient base skin 126 of the clip. This aperture forms a generally concave recess directly below the clip base 126 that enables the base to function in a trampoline-like manner and deflect into the void 146 produced by the concave recess in response to forces exerted on the midsole and the fluid bladder due to footstep heel impact on the shoe sole. In this manner, the resilient base of the bladder clip 122 functions in the same manner as the base of the first embodiment of the invention. The transparent material of the clip base also enables the viewing of the fluid bladder contained in the clip from below the shoe sole.

The outsole 120 is secured to the bottom surface of the midsole 116 by adhesives or any other equivalent method. The outsole 120 is formed with an opening 148 extending completely through the outsole at a position directly below the bladder clip base 126, fluid bladder 10 and the heel of the shoe wearer's foot. The outsole is formed of a resilient, opaque material that is slightly more rigid than the material of the clip 122 and the midsole 116 and is therefore less resistant to wear than are these other component parts of the shoe sole. The outsole 120 elevates the bottom surface of the clip base 126 above the tread surface of the shoe sole formed in the underside of the outsole and thereby protects the base from excessive wear due to use of the shoe sole. Elevating the base 126 also serves to protect the fluid bladder from being punctured by objects exterior to the shoe sole while enhancing the trampoline-like cushioning effect of the base and the fluid bladder supported on the top surface of the base.

In the still further embodiment of the invention shown in FIGS. 15–20, the fluid filled bladder 210 has an anatomical configuration designed to complement the shape of the shoe wearer's heel. As in the first embodiment, the bladder 210 is constructed from a transparent, flexible, fluid barrier material in a substantially identical manner to that of the first described embodiment. Because the second embodiment of the bladder is substantially identical to that of the first embodiment except for its configuration, it will be described together with the midsole clip with which it is used only generally. The fluid bladder 210 is formed with an inner fluid chamber 212 and an outer fluid chamber 214. The smaller, inner chamber 212 has a hollow interior filled with the same fluid 18 as that described above with reference to the first embodiment. The exterior configuration of the inner chamber 212 is defined by an inner perimeter wall 216 of the chamber that is molded in the material making up the overlapping layers of the bladder in the same manner as the first embodiment.

The larger, exterior chamber 214 has a general horseshoe shaped configuration that surrounds the inner chamber 212. The larger chamber 214 also has a hollow interior volume filled with the same fluid 18 of the first embodiment of the invention. The exterior configuration of the outer chamber 214 is defined by an inner perimeter wall 218 and a outer perimeter wall 220 formed in the overlapping layers of material that make up the bladder. Web sections 222 are formed between the inner and outer chambers of the bladder. The web sections 222 are formed in the same manner as the web sections of the first embodiment and function in the same manner.

Figure 16:
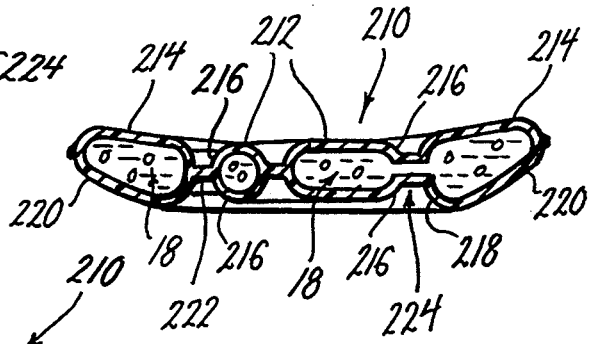
FIG. 16 is an end elevation view, in section, of the fluid bladder of FIG. 15 taken along the line 16—16.
Figure 17:
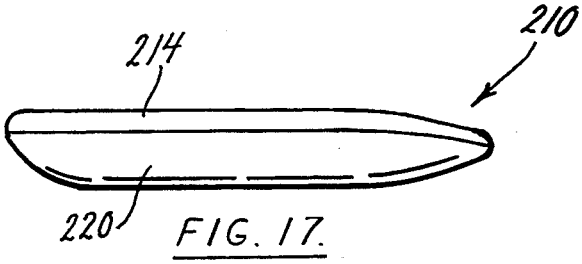
FIG. 17 is a side elevation view of the bladder of FIG. 15.

Five fluid conducting conduits 224 extend between the inner chamber 212 and the outer chamber 214 of the fluid filled bladder. The fluid conduits communicate the interior volumes of the two chambers and enable the fluid 18 to flow between the two chambers. The inner chamber 212, the web sections 222, the fluid conduits 224, and the outer chamber 214 are all substantially coplanar as shown in FIGS. 16 and 17.

The anatomically shaped fluid filled bladder 210 is employed in the two variant embodiments of the bladder clip described above with reference to the toroid shaped bladder. The two variant embodiments of the bladder clip employed with the anatomical bladder are substantially identical to the two previously described clip embodiments except that the interior cavity or interior of each of the clips is configured to receive the anatomically shaped fluid bladder 210. Because the clips are substantially identical to the first described embodiments only the one variant embodiment of the clip shown in FIGS. 18–20 will be described. This variant embodiment of the clip corresponds to the first described embodiment shown in FIGS. 1–8 and functions in substantially the same manner. Therefore, the variant embodiment of the clip shown in FIGS. 18–20 will not be described in as much detail as the first embodiment.

Like the first embodiment, the second embodiment of the shoe midsole is constructed in two component parts including an upper portion 230 and a lower portion 232. The upper midsole portion is constructed of an opaque material and the lower midsole portion is constructed of a transparent material. The forward portion 234 of the lower midsole is formed as the flexible flap of the first embodiment that is fit into a recessed plane 236 formed in the underside 238 of the upper midsole. A generally rectangular three sided ridge 240 is formed on the top surface 242 of the lower midsole. A complementary shaped three segment slot 244 is formed in the underside of the upper midsole and the ridge 240 fits into the slot 244 with the upper and lower midsoles assembled together. The ridge and slot of this embodiment function in the same manner as the ridge and slot of the first described embodiment.

Figure 18:
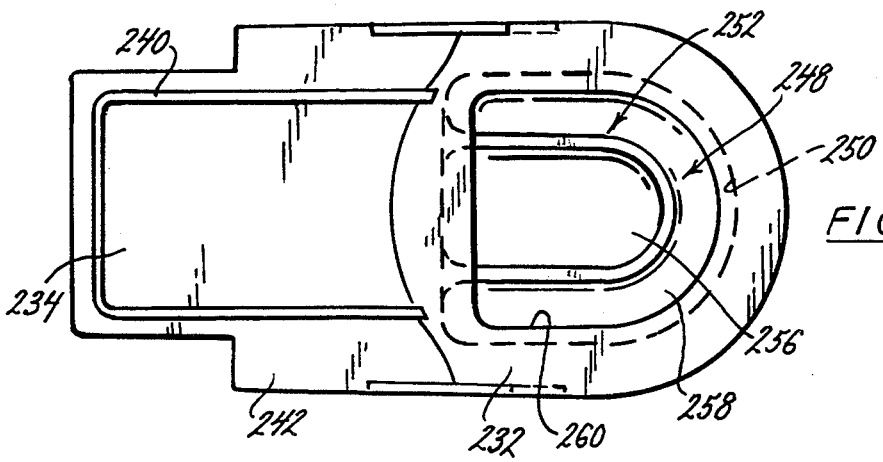
FIG. 18 is a top plan view of a modified version of the bladder clip of FIG. 6.

As the lower midsole 232 extends rearward from the forward portion 234 its vertical thickness increases in the area of the midsole just below the heel of the shoe wearer's foot. A cavity 248 is formed in this area of the lower midsole. The cavity 248 has an interior volume shaped complementary to the shape of the anatomical bladder 210 described earlier. The cavity is defined by a sidewall 250 that surrounds and engages around the periphery of the bladder, a resilient base skin 252 extending across the bottom of the cavity 248, and a top surface shaped complementary to the exterior surface of the bladder. As shown in FIG. 18, the cavity 248 is formed with a central recess 256 for the smaller, inner chamber of the bladder 210 and a peripheral recess 258 for the larger, horseshoe shaped chamber of the bladder. The cavity sidewall 250 extends upward as a unitary extension of the resilient base skin 252 from the bottom of the cavity up over a portion of the top surface of the bladder 210 to the opening 260 of the cavity in the top surface 242 of the lower midsole. In this manner, the resilient base 252 supports the fluid bladder 210 on the base top surface and the cavity sidewall 250 securely holds the bladder inside the cavity. The cavity sidewall 250 and base 252 function in the same manner as the previously described embodiment.

Figure 19:
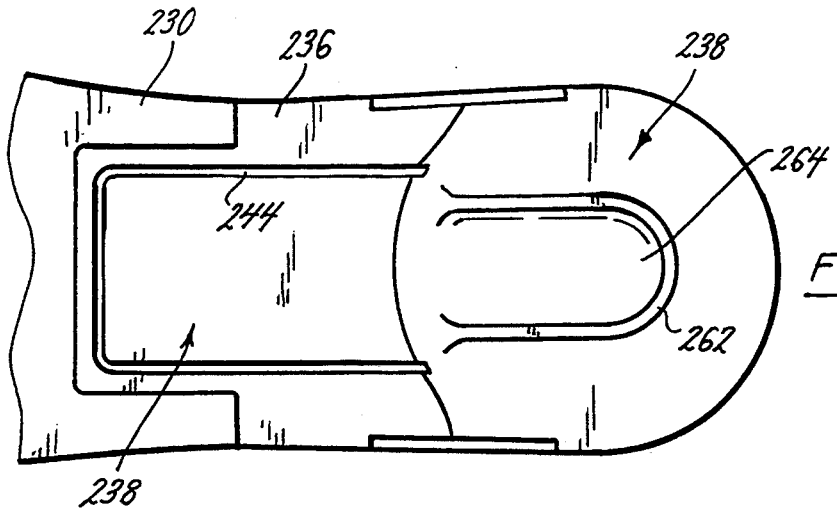
FIG. 19 is a bottom plan view of the shoe midsole configured to receive the clip of FIG. 18.
Figure 20:
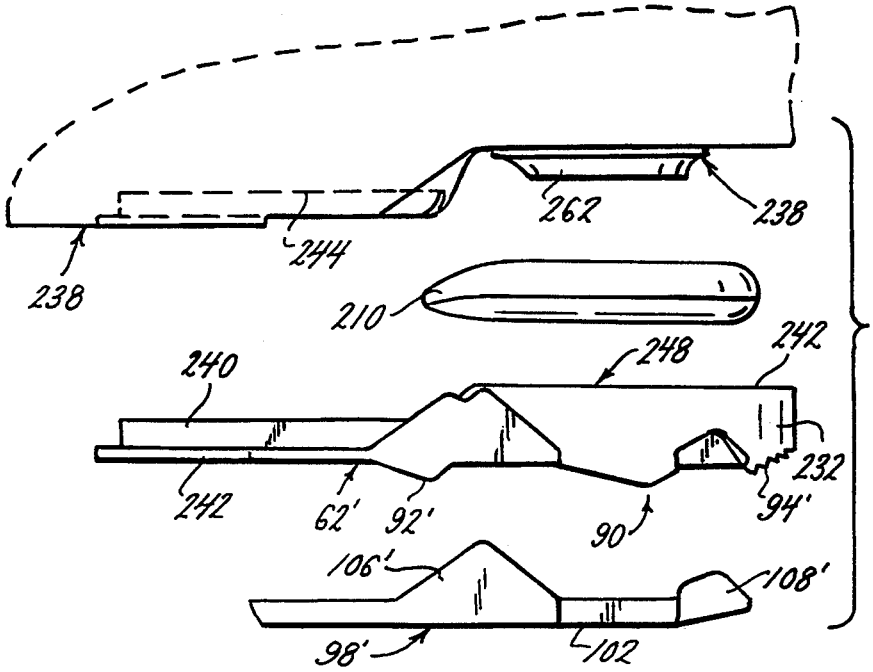
FIG. 20 is a side elevation view showing the component parts of the shoe sole of FIGS. 18 and 19.

The bottom surface or underside 238 of the upper midsole 230 Just above the lower midsole cavity 248 is given a shape complementary to the shape of the top surface of the anatomical bladder 210 and the cavity opening 260 formed in the lower midsole. The upper midsole is formed with a projecting horseshoe shaped ridge 262. A center recess 264 is formed in the center of the ridge and the underside of the upper midsole slopes away from the ridge 262 to form a surface complementary to the outside surface of the fluid bladder 210. The complementary close fitting relationship between the lower midsole cavity 250, the fluid bladder 210 and the bottom surface 238 of the upper midsole can be seen in FIG. 20 which shows an exploded view of the component parts that are assembled together to form this additional embodiment of the invention. The component parts shown in FIG. 20 are assembled in substantially the same manner as that described above with regard to FIG. 8. The remaining features of the variant embodiment shown in FIGS. 18–20 are identical to those of the previously described embodiment of FIGS. 1–8. In particular, the exterior, bottom surface of the lower midsole 232 is identical to that of the previously described embodiment in that it also includes a concave recess directly beneath the fluid bladder 210. The component parts of the embodiment of the shoe sole shown in FIGS. 18–20 that are identical to the previously described embodiment of FIGS. 1–8 are labeled with the same reference numerals as the previously described embodiment followed by a prime (').

While the present invention has been described by reference to specific embodiments, it should be understood that modifications and variations of the invention may be constructed without departing from the scope of the invention defined in the following claims.

What is claimed is:

1. A shoe sole comprising:

a bladder constructed of a fluid tight material that completely encloses a fluid filled interior volume of the bladder and defines an exterior configuration of the bladder;

a midsole constructed of a material having a first flexibility, the midsole having a top surface and a bottom surface;

a midsole clip formed separately from the midsole, the clip having a top surface and a bottom surface with a hollow cavity formed in the clip, the clip cavity containing the bladder and having an interior volume defined by a base of the clip that extends below the bladder and a cavity side wall that extends upwardly from the base and completely around the bladder exterior, the cavity side wall terminating at and defining a top opening in the clip top surface that provides access to the cavity interior, the top surface of the midsole clip being secured to the bottom surface of the midsole with a portion of the midsole bottom surface covering over the top opening in the clip top surface; and, an outsole constructed of a material having a second flexibility that is less than the flexibility of the midsole, the outsole having a top surface and a bottom surface, the outsole top surface being secured to the bottom surface of the midsole and the bottom surface of the midsole clip, and the outsole bottom surface being formed as the traction surface of the shoe sole.

2. The shoe sole of claim 1, wherein:

the midsole clip is constructed of a transparent material and both the midsole and the outsole are constructed of opaque materials.

3. The shoe sole of claim 2, wherein:

the outsole has an opening therethrough beneath the midsole clip cavity where the bladder is visible in the clip cavity through the outsole opening and the transparent material of the midsole clip.

4. The shoe sole of claim 1, wherein:

the portion of the midsole bottom surface that covers over the top opening in the clip top surface extends downwardly through the clip top opening and into the cavity interior.

5. The shoe sole of claim 1, wherein:

the exterior configuration of the bladder includes a top surface and a bottom surface of the bladder and a side surface of the bladder extending between the top and bottom surfaces completely around a perimeter of the bladder;

and the cavity sidewall extends completely around and engages against the side surface of the bladder and over a portion of the top surface of the bladder, the top opening to the cavity interior having a smaller perimeter than the perimeter of the bladder.

6. The shoe sole of claim 4, wherein:

the portion of the midsole bottom surface that extends downwardly through the top opening in the midsole clip engages with the bladder contained in the clip interior.

7. The shoe sole of claim 3, wherein:

a portion of the bottom surface of the midsole clip has a concave configuration directly below the clip cavity, and the opening through the outsole is directly below the concave portion of the clip bottom surface.

8. The shoe sole of claim 1, wherein:

a concave depression is formed in the bottom surface of the midsole clip directly beneath the cavity, and the base at the bottom of the cavity has a center section and a peripheral section surrounding the center section, where the depression in the bottom surface of the midsole clip elevates the base center section relative to the base peripheral section in the cavity interior.

9. A shoe sole comprising:

a bladder constructed of a transparent, fluid tight material completely enclosing an interior volume of the bladder, the interior volume of the bladder being filled with a fluid, the bladder having a top surface, a bottom surface and a side surface extending around a perimeter of the bladder between the top and bottom surfaces, together the top, bottom and side surfaces of the bladder define an exterior configuration of the bladder;

a midsole constructed of an opaque material having a first flexibility, the midsole having a top surface and a bottom surface;

a midsole clip constructed of a transparent material, the clip having a top surface and a bottom surface with a hollow cavity formed in the clip between the top and bottom surfaces, an opening extends through the clip top surface to the cavity providing access to an interior volume of the cavity through the opening, the cavity interior volume having a configuration defined by a base surface of the clip at the cavity bottom recessed below the clip opening, an interior side wall that extends completely around the base surface and that has a generally concave configuration as the side wall extends upwardly from the base surface to the clip opening, the generally concave configuration of the interior side wall giving the cavity interior volume a perimeter at the side wall that is larger than a perimeter of the clip opening, and the bladder being inserted inside the clip cavity with the interior sidewall of the cavity engaging completely around the bladder side surface and over a portion of the bladder top surface to thereby hold the bladder in the cavity, the top surface of the clip being secured to the bottom surface of the midsole with the midsole covering over the opening in the clip top surface; and an outsole constructed of an opaque material having a second flexibility less than the first flexibility of the midsole, the outsole having a top surface and a bottom surface, the top surface being secured to the bottom surface of the midsole and the outsole bottom surface being formed as a tread surface of the shoe sole.

10. The shoe sole of claim 9, wherein:

a portion of the midsole bottom surface that covers the clip top opening extends downwardly through the clip top opening and into the cavity interior.

11. The shoe sole of claim 9, wherein:

the perimeter of the bladder is larger than the perimeter of the clip opening.

12. The shoe sole of claim 9, wherein:

the bottom surface of the midsole clip has a concave depression therein, the depression being positioned directly beneath the clip cavity and the bladder contained therein.

13. The shoe sole of claim 12, wherein:
the outsole has an opening therethrough directly beneath the concave depression formed in the bottom surface of the midsole clip.

14. The shoe sole of claim 10, wherein:
the portion of the midsole bottom surface that extends downwardly through the top opening in the midsole clip engages with the bladder contained in the clip interior.

15. The shoe sole of claim 9, wherein:
a concave depression is formed in the bottom surface of the midsole clip directly beneath the cavity, and the base at the bottom of the cavity has a center section and a peripheral section surrounding the center section, where the depression in the bottom surface of the midsole clip elevates the base center section relative to the base peripheral section in the cavity interior.

16. A shoe sole comprising:
a fluid bladder constructed of a transparent, fluid tight material completely enclosing an interior volume of the bladder, a fluid filling the interior volume of the bladder, the bladder having a top surface and a bottom surface that come together at a peripheral side surface of the bladder, the top, bottom and side surfaces of the bladder together defining an exterior configuration of the bladder;
a midsole constructed of an opaque material having a first flexibility, the midsole having a top surface and a bottom surface and a peripheral side surface that extends completely around the midsole between the midsole top and bottom surfaces;
a midsole clip constructed of a transparent material having a second flexibility less than the first flexibility of the midsole, the clip having a top surface and a bottom surface and a hollow cavity formed in the clip between the top and bottom surfaces, the clip having an opening in the top surface providing access to the cavity within the clip, the cavity having a bottom defined by a base of the clip, and the cavity having a perimeter defined by a peripheral interior side wall of the clip that extends upwardly as a unitary extension of the base completely around the perimeter of the cavity and then extends over a portion of the cavity to the opening in the top surface of the clip, whereby the top opening has a perimeter that is smaller than the perimeter of the cavity, the bladder is inserted as a unit inside the clip cavity on top of the base and the interior side wall of the clip cavity engages around the peripheral side surface of the bladder and around a portion of the bladder top surface, and the top surface of the clip is secured to the bottom surface of the midsole with the midsole covering over the top opening of the clip; and,
an outsole constructed of an opaque material having a third flexibility that is less than the first flexibility of the midsole and the second flexibility of the clip, the outsole being secured to the bottom surface of the midsole and the bottom surface of the clip, and the outsole having an opening therethrough beneath the base of the clip, the clip base being visible through the outsole opening.

17. The shoe sole of claim 16, wherein:
a concave depression is formed in the bottom surface of the midsole clip directly beneath the cavity and the bladder inserted into the cavity and directly over the outsole opening.

18. The shoe sole of claim 16, wherein:
the midsole clip and the bladder inserted in the midsole cavity are encapsulated in the midsole within the peripheral side surface of the midsole, and at least one aperture is provided in the midsole side surface extending through the midsole to the clip therein, the clip being visible through the aperture.

19. The shoe sole of claim 16, wherein:
the midsole clip has opposite medial and lateral side surfaces that are coextensive with the peripheral side surface of the midsole and together with the peripheral side surface of the midsole form external side surfaces of the shoe sole.

20. The shoe sole of claim 16, wherein:
a concave depression is formed in the bottom surface of the midsole clip directly beneath the cavity, and the base at the bottom of the cavity has a center section and a peripheral section surrounding the center section, where the depression in the bottom surface of the midsole clip elevates the base center section relative to the base peripheral section in the cavity interior.

21. A shoe sole comprising:
a bladder constructed of a fluid tight material that completely encloses a fluid filled interior volume of the bladder, the bladder having top and bottom surfaces and a peripheral sidewall extending completely around the bladder and connecting the top and bottom surfaces, the top and bottom surfaces and the sidewall together enclosing the fluid filled interior volume of the bladder;
a midsole constructed of a flexible material, the midsole having opposite top and bottom surfaces;
a midsole clip formed separately from the midsole, the midsole clip having a top surface and a bottom surface with a hollow cavity in the clip between the top and bottom surfaces, the clip cavity containing the bladder and having an interior volume defined by a clip base that extends below and engages with the bottom surface of the bladder and a cavity sidewall that extends upwardly from the base and extends completely around the bladder peripheral sidewall engaging with the bladder sidewall and surrounding the bladder, the upward extension of the cavity sidewall from the cavity base terminates at a top edge of the cavity sidewall that surrounds a top opening in the clip top surface that provides access to the cavity interior; and,
an outsole constructed of a flexible material, the outsole having a top surface and a bottom surface, the outsole top surface is affixed to the midsole bottom surface and the midsole clip and bladder are encapsulated in the shoe sole between the midsole and outsole, and the outsole bottom surface is formed as a traction surface of the shoe sole.

22. The shoe sole of claim 21, wherein:
the top surface of the midsole clip is affixed to the bottom surface of the midsole and a portion of the midsole bottom surface extends through the top opening in the clip top surface and into the interior volume of the cavity surrounded by the clip sidewall 23. The shoe sole of claim 21, wherein:
the midsole clip, the midsole and the outsole are all formed separately and of different materials with the midsole clip being formed of a transparent material.

24. The shoe sole of claim 21, wherein:

the cavity sidewall intermediate the base and the top edge of the cavity sidewall has a larger periphery than the top edge of the sidewall surrounding the top opening in the clip top surface.

25. The shoe sole of claim 21, wherein:

the peripheral sidewall of the bladder has a larger periphery than the top edge of the cavity sidewall surrounding the top opening in the clip top surface.

* * * * *